United States Patent [19]

Di Egidio

[11] Patent Number: 4,552,357

[45] Date of Patent: Nov. 12, 1985

[54] SPORTS GEOGRAPHY JACKSTRAW GAME

[76] Inventor: Leo C. Di Egidio, 32874 Burlwood Dr., Solon, Ohio 44139

[21] Appl. No.: 646,020

[22] Filed: Aug. 31, 1984

Related U.S. Application Data

[63] Continuation of Ser. No. 428,626, Sep. 30, 1982, abandoned.

[51] Int. Cl.[4] ..... A63F 9/00; A63F 3/04

[52] U.S. Cl. ..... 273/1 GG; 273/285; 273/DIG. 30; 434/150

[58] Field of Search ..... 273/1 GG, 283, 285, 273/275, 276, 266; 434/150–153

[56] References Cited

U.S. PATENT DOCUMENTS

| | | | |
|---|---|---|---|
| 1,595,285 | 8/1926 | Beyan | 273/282 |
| 1,885,260 | 11/1932 | Hoglind | 273/1 GG |
| 1,966,793 | 7/1934 | Fuller | 273/282 X |
| 2,837,836 | 6/1958 | Morawitz | 434/150 X |
| 3,023,006 | 2/1962 | Kovacs | 273/285 X |
| 3,363,902 | 1/1968 | Jones | 234/150 X |
| 3,633,913 | 1/1972 | Solimene | 273/285 X |

OTHER PUBLICATIONS

Playthings, 5–1972, p. 37, Jack Straws.

*Primary Examiner*—Paul E. Shapiro
*Attorney, Agent, or Firm*—Porter & Bremer Co.

[57] ABSTRACT

Jackstraws bearing various geographic and sports indicia thereon are employed in conjunction with a game board having a map illustrated on a playing surface. Jackstraw receptacles in the playing surface are positioned about the map in the vicinity of cities having major sports teams. The game board itself is comprised of a hinged box; the top and bottom of the box form the playing surface when the box is open and the box halves laid flat. A chamber is formed between the box top and bottom when the box is closed. The jackstraws can be stored in the chamber when not in use.

11 Claims, 7 Drawing Figures

SPORTS GEOGRAPHY JACKSTRAW GAME

CROSS REFERENCE TO RELATED APPLICATION

This is a continuation of application Ser. No. 428,626, filed Sept. 30, 1982, now abandoned.

BACKGROUND OF THE INVENTION

1. Field of the Invention

The invention relates to games for amusement and education and, more particularly, to a game utilizing jackstraws in conjunction with a game board.

2. Description of the Prior Art

The game of jackstraws or "pick-up-sticks" is a classic children's game in which a number of narrow sticks are tossed into a jumbled heap, the object being to remove the sticks, one at a time, without disturbing any of the others. In removing the sticks from the heap a child's dexterity and patience are developed by way of the game. The game is tried and true, having been successfully put to the test by countless children for many years. Further, such a game is easily manufactured, durable, and in an age of complex electronic toys, inexpensive to purchase.

Even though the game of jackstraws has been very successful, the test of a truly beneficial and useful game is one in which children may learn while still having fun. Thus, by incorporating an educational bias into an already successful and attention-holding game such as jackstraws, the object of amusing yet educating children will be achieved.

SUMMARY OF THE INVENTION

The present invention, in response to the foregoing considerations, prevents a novel and improved game apparatus employing jackstraws bearing various geographic and sports indicia in conjunction with a game board having a map illustrated on a playing surface. Receptacles in the playing surface are positioned about the map in the vicinity of cities having major sports teams. The game board itself is comprised of a hinged box. The top and bottom of the box forming the playing surface when the box is open and the box halves laid flat. A chamber is formed between the box top and bottom when the box is closed. The jackstraws may be stored in the chamber.

In order to play the game, jackstraws are gathered up and tossed into a jumbled heap. Players must remove one jackstraw at a time from the heap without disturbing the heap. Successfully removed jackstraws are then inserted into the appropriate receptacle in the playing surface. Determination of the appropriate receptacle is based upon a player's knowledge of geography since he must locate the receptacle corresponding to the city indicium on the jackstraw. Additional points are earned by players who correctly name the sports team represented by the sports indicium on the jackstraw. The player who correctly places the most jackstraws and correctly names the mosts sports teams represented by each jackstraw is declared the winner.

DESCRIPTION OF THE PREFERRED EMBODIMENT

Figure 1:
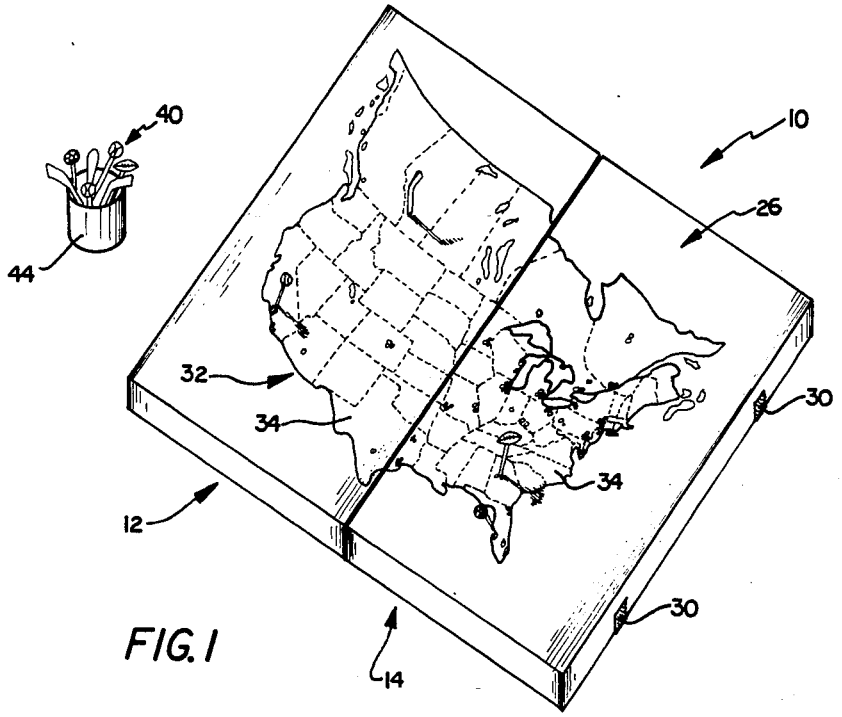
FIG. 1 is perspective view of a game board and jackstraws according to the invention.
Figure 2:
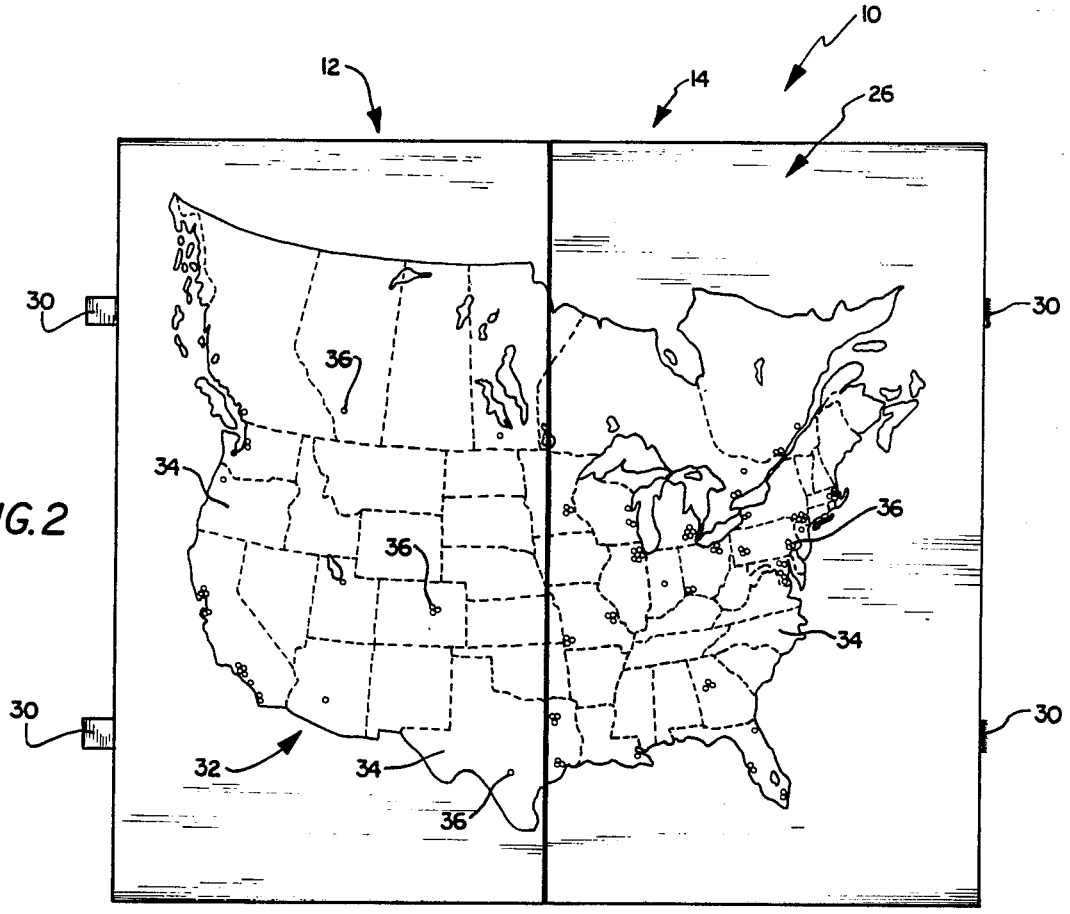
FIG. 2 is a plan view of the game board according to to the invention, with a map being shown on the playing surface.
Figure 3:
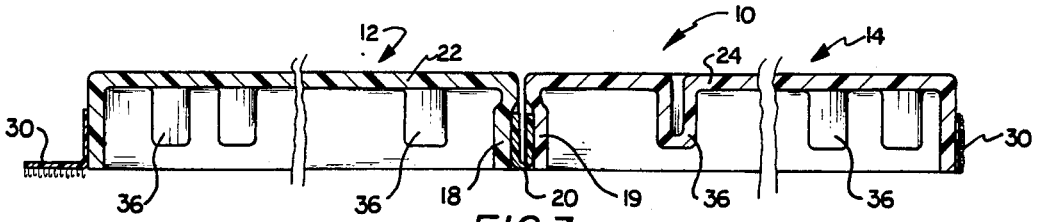
FIG. 3 is a cross-sectional view through the game board in the open playing position.
Figure 4:
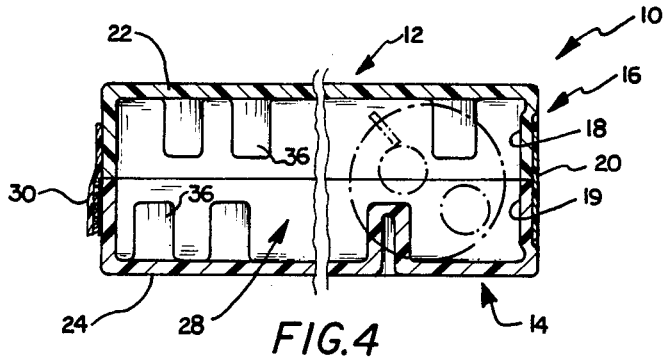
FIG. 4 is a cross-sectional view through the game board in the closed position.
Figure 5:
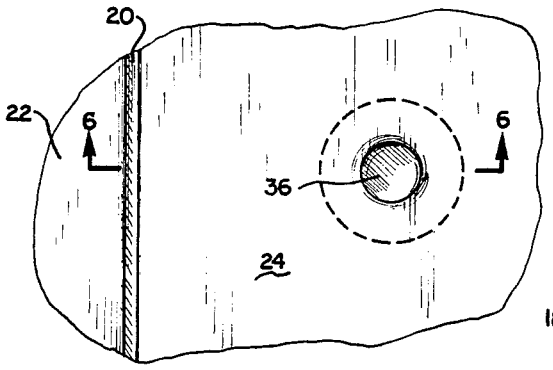
FIG. 5 is an enlarged plan view of a jackstraw slot in the game board near the abutting sides of the box halves which form the game board.

Referring to FIGS. 1, 2, 3 and 4, a game board according to the present invention is generally indicated by the numeral 10. The game board 10 includes two halves 12, 14 defining a box structure 16 (FIG. 4). The box halves 12, 14 are joined at their abutting sides 18, 19 by hinge 20. The top 22 and bottom 24 of box 16 together form a playing surface 26 of game board 10 when box 16 is opened and the hinged sides 18, 19 of each half 12, 14 abut each other (FIG. 3). When the box halves 12, 14 are closed together, they form a chamber 28 in which playing pieces may be stored. The box halves 12, 14 are held closed by fasteners 30 such as VELCRO tabs.

The playing surface 26 has a map 32 illustrated thereon. Another map (not shown) may be included as part of the walls of the chamber 28 in order to provide answers to the game to be played. The map 32 in the preferred embodiment is that of the continental United States and southern provinces of Canada although any geographic region may be depicted. Map 14 is divided into political subdivisions or states 34. Map 14 also may be colored so as to create an interesting visual effect. Positioned about map 14 are a plurality of receptacles 36 representing major sports teams of particular cities. For example, in the vicinity of the city of Philadelphia, three recpetacls 36 are shown in FIG. 2. Each receptacle 36 might represent one of three major Philadelphia based sports teams, for example, the Philadelphia Flyers (hockey), Phillies (baseball), and Eagles (football). Another desirable approach (not shown) would be to provide only one receptacle 36 adjacent each city; in that event, the game would be played using jackstraws of only a single sport at any one time.

Figure 6:
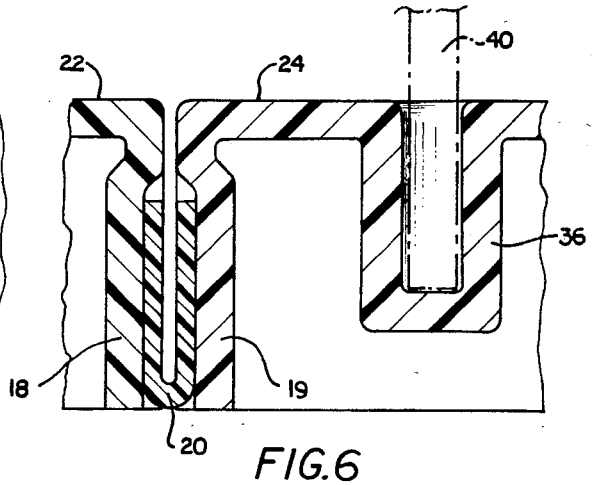
FIG. 6 is a cross-sectional view taken along a plane indicated by line 6—6 in FIG. 5.
Figure 7:
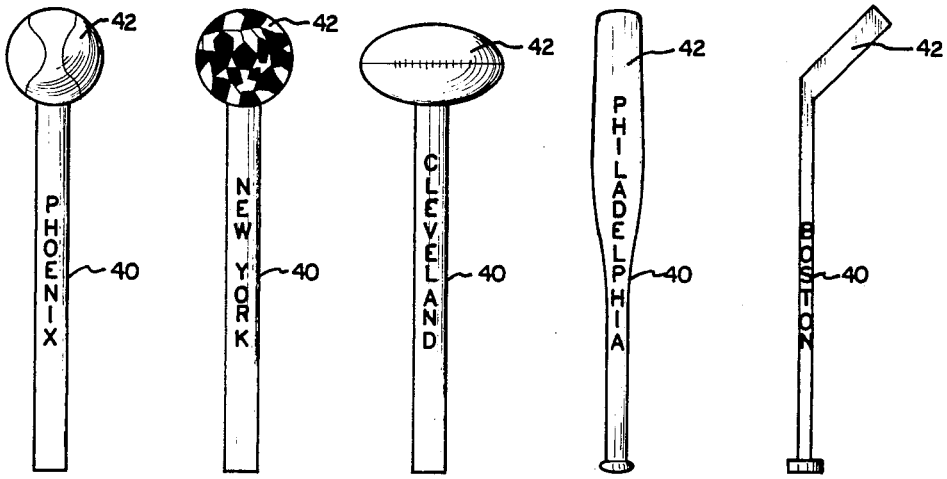
FIG. 7 is a side elevational view of jackstraws according to the present invention.

The receptacles 36 in the preferred embodiment, best shown in FIG. 6, having an internal diameter slightly larger than the outer diameter of a jackstraw playing piece 40, to thereby snugly hold jackstraws 40 inserted therein. Jackstraws 40 are elongate playing pieces and in the preferred embodiment, have game indicia 42 thereon. Examples of these jackstraws are shown in FIG. 7. In the preferred embodiment, each of the jackstraws 40 has an elongate stem portion having a generally constant cross-section and a length to width ratio greater then 10, and an end portion having the game indicia 42 thereon. The end portion is larger than the cross-section of the stem portion. Game indicia 42 include three-dimensional representations of sports equipment such as basketballs, soccerballs, footballs, baseball bats, hockey sticks, and the like. Game indicia 42 also include the names of cities whose major sports are represented by the sports equipment indicia. For example, a jackstraw 40, shaped like a baseball bat and bearing "Philadelphia", would be a jackstraw representative of the Philadelphia Phillies.

METHOD OF PLAY

To begin play, jackstraws 40 are gathered together in a container 44 from which the jackstraws are tossed into a jumbled heap (not shown). Players, in turn, must remove one jackstraw 40 at a time from the heap without disturbing the others. Any disturbance of the heap results in that player losing his turn to the next player. Once the jackstraw 40 has been successfully removed, the end of the jackstraw 40 is inserted into the appropriate receptacle 36 on the playing surface 26. A player must determine which receptacle 36 is the appropriate one. For example, if the successfully removed jackstraw 40 has the game indicia 42 of a football and "Philadelphia", the player must know the location of the city of Philadelphia on the map 32 in order to insert the end of the jackstraw 40 into the correct receptacle 36. Once the correct receptacle 36 has been selected, a player may earn additional points by correctly naming the team nickname represented by the indicia 42 on that particular jackstraw 40. For example, jackstraw 40 having game indicia 42 of a football and "Philadelphia" would earn points indentifying the team represented by the indicia as the "Eagles".

Once all of the jackstraws 40 have been correctly placed in receptacles 36 in game board 10, the player who has correctly positioned the most jackstraws 40 and properly named the teams represented thereby, is declared the winner.

Although the invention has been described in its preferred form with a certain degree of particularity it will be understood that the present disclosure of the preferred form has beeen made only by way of example and that numerous changes in the details of construction and the combination and arrangement of parts may be resorted to without departing from the true spirit and scope of the invention as hereinafter claimed.

What is claimed is:

1. A game of jackstraws, comprising:

a game board having a top surface and a bottom surface;

a map displayed on the top surface of the game board;

a plurality of jackstraw-receiving means on the game board, said jackstraw-receiving means being located in the vicinity of pre-determined geographic sites displayed on said map, the pre-determined geographic sites identifying cities having major league sports teams; and a plurality of jackstraws, each having an elongate stem portion having a generally constant cross-section and a length to width ratio greater than 10, and an end portion having game indicia thereon, the end portion being larger than the cross-section of the stem portion, the stem portion adapted to be inserted into the jackstraw-receiving means, each of the jackstraws also including indicia corresponding to a selected geographic site, the game indicia being in the form of three-dimensional representations of sports equipment corresponding to sports equipment utilized by major league sports teams in the pre-determined geographic sites.

2. The jackstraw game of claim 1, wherein the game board is comprised of complementary halves of a box, the halves being joined by a hinge means, whereby the box may be opened and the halves laid flat to form a playing surface when the hinged sides of each half are abutting each other.

3. The jackstraw game of claim 2 wherein the box halves when closed define a chamber.

4. The jackstraw game of claim 3, wherein the two box halves are held closed by fastening means.

5. The jackstraw game of claim 1, wherein the map depicts portions of the United States of America and Canada.

6. The jackstraw game of claim 1, wherein the jackstraw supporting means are in the form of recesses in the game board into which the jackstraw ends are inserted and snugly held.

7. The jackstraw game of claim 1, wherein the jackstraw supporting means are in the form of apertures in the game board, the diameter of the apertures being larger than the diameter of the jackstraw ends.

8. The jackstraw game of claim 1, wherein the jackstraws are in the form of hockey sticks.

9. A method of playing a game of jackstraws, comprising the steps of:

providing a game board having a top surface and a bottom surface;

providing a map on the surface of the game board;

providing a plurality of jackstraw-receiving means on the game board, said jackstraw-receiving means being located in the vicinity of pre-determined geographic sites displayed on said map;

providing a plurality of jackstraws, each having an elongate stem portion, a first end portion having game indicia thereon, and a second end portion adapted to be inserted into the jackstraw receiving means, each of the jackstraws also including indicia corresponding to a selected geographic site; and tossing the jackstraws into a jumbled heap, removing jackstraws one at a time from the heap without disturbing the heap, and inserting removed jackstraws into jackstraw-receiving means corresponding to indicia contained on the removed jackstraws.

10. The method of claim 9, wherein the pre-determined geographic sites are cities having major league sports teams.

11. The method of claim 10, wherein the game indicia are three-dimensional representations of sports equipment corresponding to sports equipment utilized by major leaque sports teams in the pre-determined geographic sites.

* * * * *